US009579702B2

(12) United States Patent
Yowell

(10) Patent No.: US 9,579,702 B2
(45) Date of Patent: Feb. 28, 2017

(54) ROLLER FOR FORMING HEAT TRANSFER ELEMENTS OF HEAT EXCHANGERS

(71) Applicant: ARVOS TECHNOLOGY LIMITED, Brugg (CH)

(72) Inventor: Jeffery E. Yowell, Wellsville, NY (US)

(73) Assignee: ARVOS INC., Wellsville, NY (US)

( * ) Notice: Subject to any disclaimer, the term of this patent is extended or adjusted under 35 U.S.C. 154(b) by 845 days.

(21) Appl. No.: 13/751,640

(22) Filed: Jan. 28, 2013

(65) Prior Publication Data

US 2014/0209287 A1 Jul. 31, 2014

(51) Int. Cl.

| | |
|---|---|
| ***B21B 27/00*** | (2006.01) |
| ***B21B 27/02*** | (2006.01) |
| ***B21D 13/04*** | (2006.01) |
| ***B21D 53/04*** | (2006.01) |
| ***F28F 3/02*** | (2006.01) |

(52) U.S. Cl.

CPC ..... *B21B 27/005* (2013.01); *B21B 27/02* (2013.01); *B21D 13/04* (2013.01); *B21D 53/04* (2013.01); *F28F 3/02* (2013.01); *Y10T 29/4956* (2015.01)

(58) Field of Classification Search

CPC ..... B21B 27/005; B21B 27/00; B21B 27/02; F28F 3/02; B21D 13/04; B21D 53/04; Y10T 29/49544; Y10T 29/49547; Y10T 29/49549; Y10T 29/49551; Y10T 29/49554; Y10T 29/4956; Y10T 29/49561

See application file for complete search history.

(56) References Cited

U.S. PATENT DOCUMENTS

| | | | | |
|---|---|---|---|---|
| 682,607 | A * | 9/1901 | Eck | B65H 27/00 492/40 |
| 1,450,351 | A * | 4/1923 | Beran | B21D 13/04 72/196 |
| 3,940,966 | A | 3/1976 | Deane | |
| 5,150,596 | A * | 9/1992 | Hunt | B21D 53/04 72/186 |
| 6,730,008 | B1 * | 5/2004 | Liang | F16C 13/00 492/40 |
| 7,654,067 | B2 | 2/2010 | Wattron | |

FOREIGN PATENT DOCUMENTS

| | | |
|---|---|---|
| CA | 1061653 | 9/1979 |
| EP | 0150913 A2 | 7/1985 |
| EP | 0945195 | 9/1999 |
| GB | 177780 | 2/1923 |

* cited by examiner

*Primary Examiner* — Sarang Afzali
(74) *Attorney, Agent, or Firm* — MKG, LLC

(57) ABSTRACT

A roller for forming heat transfer elements may include a central shaft and a plurality of roller elements. The plurality of roller elements may be stacked on the central shaft. Each roller element defines an outer periphery, which is configured to include a geometrical characteristic thereacross. The stacked roller elements, either stacked on the central shaft or stacked without using the central shaft, configures the roller with a circumferential surface corresponding to the geometrical characteristic of the stacked roller elements, to form the heat transfer elements corresponding to the circumferential surface.

11 Claims, 6 Drawing Sheets

ROLLER FOR FORMING HEAT TRANSFER ELEMENTS OF HEAT EXCHANGERS

BACKGROUND

1. Field of Endeavor

The present disclosure relates to heat exchangers, and more particularly to rollers for forming heat transfer elements used in such heat exchangers, for transferring heat.

2. Brief Description of the Related Art

Heat exchangers, such as rotary regenerative air preheaters, include various heat transfer elements stacked therein to transfer heat from a hot gas stream to a cold gas stream. For effective transfer of heat, the heat transfer elements include one or more geometric characteristics, such as undulations, corrugations, notches and flats. Generally, such characteristics are formed by roll pressing metallic sheets or plates between a pair of metallic rollers, which include one or more similar characteristics across its circumference. The characteristics formed on the roll pressed metallic sheet correspond to characteristics across the circumference of press rollers.

The metallic rollers with said characteristics are generally produced by machining the rollers across its circumference. Machining the said characteristics or its various combinations on metallic rollers may be very cumbersome, tedious and time taking job, apart from being uneconomical. Further, such machining of rollers generally also limits the characteristics to current machining technologies and practices and the geometry of uninterrupted characteristics. Moreover, loading and unloading of such metallic rollers on roller pressing machines for forming the heat transfer elements with varying characteristics may also add to its overall tediousness and time.

SUMMARY

The present disclosure describes a roller for forming heat transfer elements of heat exchangers that will be presented in the following simplified summary to provide a basic understanding of one or more aspects of the disclosure that are intended to overcome the discussed drawbacks, but to include all advantages thereof, along with providing some additional advantages. This summary is not an extensive overview of the disclosure. It is intended to neither identify key or critical elements of the disclosure, nor to delineate the scope of the present disclosure. Rather, the sole purpose of this summary is to present some concepts of the disclosure, its aspects and advantages in a simplified form as a prelude to the more detailed description that is presented hereinafter.

An object of the present disclosure is to describe a roller with geometrical characteristics that are comparatively economical, easy and less time consuming in formation as against conventional machined rollers. Another object of the present disclosure is to describe a method of formation of rollers in convenient and economical manner, and within substantially less time. Another object of the present disclosure is to describe formation of heat transfer plates and a roller arrangement for formation thereof. Yet another object of the present disclosure is to preclude loading and unloading of rollers from roller arrangements, each time a new heat transfer element profile is required to be formed. Various other objects and features of the present disclosure will be apparent from the following detailed description and claims.

The above noted and other objects, in one aspect, may be achieved by a roller of the present disclosure for forming heat transfer elements of heat exchangers. In other aspects, above noted and other objects, may be achieved by a method for forming the roller, a roller arrangement having the rollers for forming heat transfer elements, and a method for obtaining heat transfer elements of heat exchangers.

According to the first aspect of the present disclosure, a roller for forming heat transfer elements of heat exchangers is provided. The roller includes a plurality of roller elements, each defining an outer periphery. Each roller element includes a geometrical characteristic configured across the outer periphery thereof. The plurality of roller elements adapted to be stacked to configure the roller with a circumferential surface corresponding to the geometrical characteristic of the stacked roller elements, to form the heat transfer elements corresponding to the circumferential surface.

In further aspect of the present disclosure, the roller for forming heat transfer element with a central shaft and a plurality of roller elements adapted to be stacked on the central shaft is provided. Each roller element defines an outer periphery, which is configured to include a geometrical characteristic thereacross. In one embodiment, each roller element may be a substantially thin metallic sheet having one of a flat shape or a non-flat shape, cut from a metallic sheet. Further, each roller element is shaped in one of a circular shape or a non-circular shape. The stacked roller elements on the central shaft configures the roller with a circumferential surface corresponding to the geometrical characteristic of the stacked roller elements, to form the heat transfer elements corresponding to the circumferential surface. In one form, the geometrical characteristic, without any limitation, may be at least one of undulations, corrugations, flats and notches ribs, tabs, dimples and ripples, which may be cut by required tools or may be cut by laser or any other digital methods.

In one embodiment, each roller element comprises a cutout, defining an inner periphery opposite to the outer periphery, through which each roller element is stacked on the central shaft.

In one embodiment, an engaging arrangement to enable proper stacking of the plurality of roller elements on the central shaft is described. The engaging arrangement may include an engaging member extending longitudinally on a surface of the central shaft; and a complementary engaging member extending downwardly from the inner periphery of each roller element to match the engaging member to stack the plurality of roller elements on the central shaft. The engaging member may be a grove, and the complementary engaging member may be a protrusion.

In another aspect of the present disclosure, a method for forming the roller is described. The method includes:

forming a central shaft;

cutting a plurality of roller elements from a metallic sheet, each roller element defining an outer periphery;

forming a geometrical characteristic across the outer periphery of each of the roller element; and stacking the plurality of roller elements on the central shaft to configure the roller with a circumferential surface corresponding to the geometrical characteristic of the stacked roller elements, to form the heat transfer elements corresponding to the circumferential surface.

In one another aspect of the present disclosure, a roller arrangement for forming heat transfer elements of heat exchangers is described. The roller arrangement includes a pair of rollers, each roller comprising, a central shaft, and a plurality of roller elements, each defining an outer periphery, each roller element comprising a geometrical characteristic configured across the outer periphery thereof, the plurality of roller elements adapted to be stacked on the central shaft, the stacked roller elements on the central shaft configures the roller with a circumferential surface corresponding to the geometrical characteristic of the stacked roller elements, the pair of rollers disposed parallel in spaced manner to configure a nip, the pair of rollers rotatable along respective axes for enabling the nip to receive metallic sheets to form the heat transfer elements corresponding to the circumferential surface.

In yet further aspect of the present disclosure, a method for forming heat transfer elements of heat exchangers. The method comprising:

arranging a pair of rollers in spaced manner to configure a nip, the pair of rollers rotatable along respective axes thereof, each roller comprising, a central shaft, and a plurality of roller elements, each defining an outer periphery, each roller element comprising a geometrical characteristic configured across the outer periphery thereof, the plurality of roller elements adapted to be stacked on the central shaft, the stacked roller elements on the central shaft configures the roller with a circumferential surface corresponding to the geometrical characteristic of the stacked roller elements; and passing metallic sheets from the nip of the pair of rollers to form the heat transfer elements corresponding to the circumferential surface of the pair of rollers.

In one embodiment of the above aspect of methods and roller arrangement, the formation of the roller may be obtained without stacking thereof on the central shaft.

These together with the other aspects of the present disclosure, along with the various features of novelty that characterize the present disclosure, are pointed out with particularity in the present disclosure. For a better understanding of the present disclosure, its operating advantages, and its uses, reference should be made to the accompanying drawings and descriptive matter in which there are illustrated exemplary embodiments of the present disclosure.

BRIEF DESCRIPTION OF THE DRAWINGS

The advantages and features of the present disclosure will be better understood with reference to the following detailed description and claims taken in conjunction with the accompanying drawing, wherein like elements are identified with like symbols, and in which:

Like reference numerals refer to like parts throughout the description of several views of the drawings.

DETAILED DESCRIPTION OF THE PRESENT DISCLOSURE

For a thorough understanding of the present disclosure, reference is to be made to the following detailed description, including the appended claims, in connection with the above described drawings. In the following description, for purposes of explanation, numerous specific details are set forth in order to provide a thorough understanding of the present disclosure. It will be apparent, however, to one skilled in the art that the present disclosure can be practiced without these specific details. In other instances, structures and devices are shown in block diagrams form only, in order to avoid obscuring the disclosure. Reference in this specification to "one embodiment," "an embodiment," "another embodiment," "various embodiments," means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but may not be of other embodiment's requirement.

Although the following description contains many specifics for the purposes of illustration, anyone skilled in the art will appreciate that many variations and/or alterations to these details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure. Further, the relative terms, such as "inner," "outer," "distal," "proximal," "middle" and the like, herein do not denote any order, elevation or importance, but rather are used to distinguish one element from another. Further, the terms "a," and "an" herein do not denote a limitation of quantity, but rather denote the presence of at least one of the referenced item.

Figure 1A:
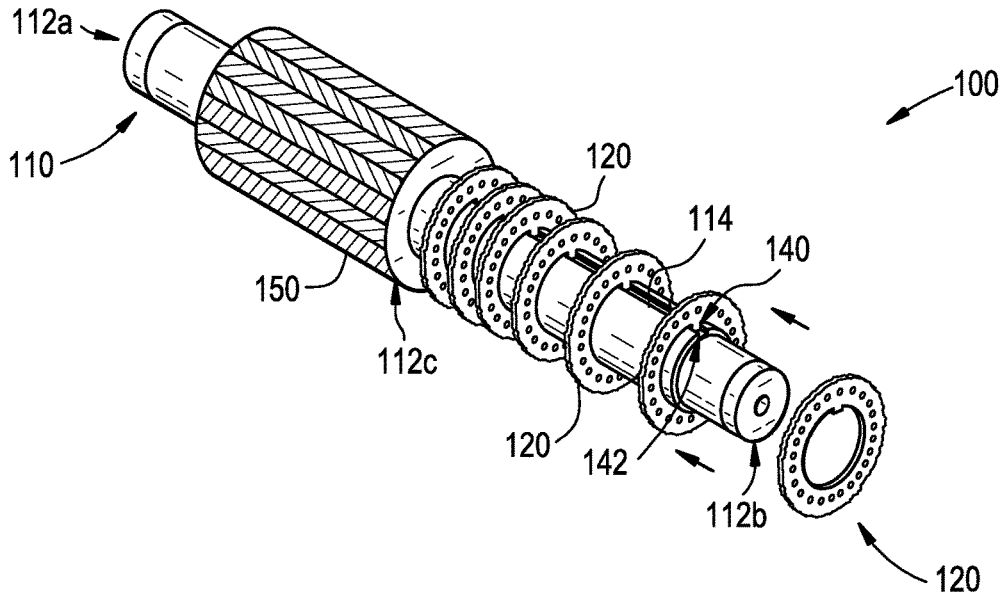
FIGS. 1A and 1B, respectively, illustrate a perspective and side views of a partially stacked roller for forming heat transfer elements of heat exchangers, in accordance with an exemplary embodiment of the present disclosure.
Figure 1B:
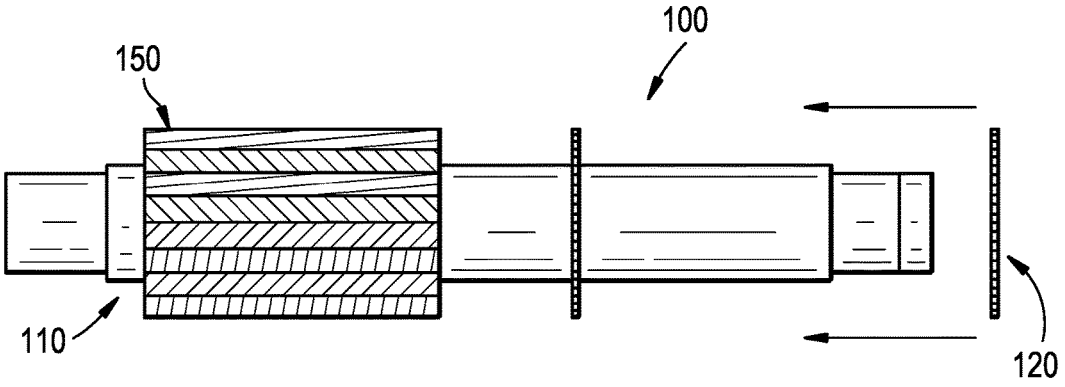
Figure 1C:
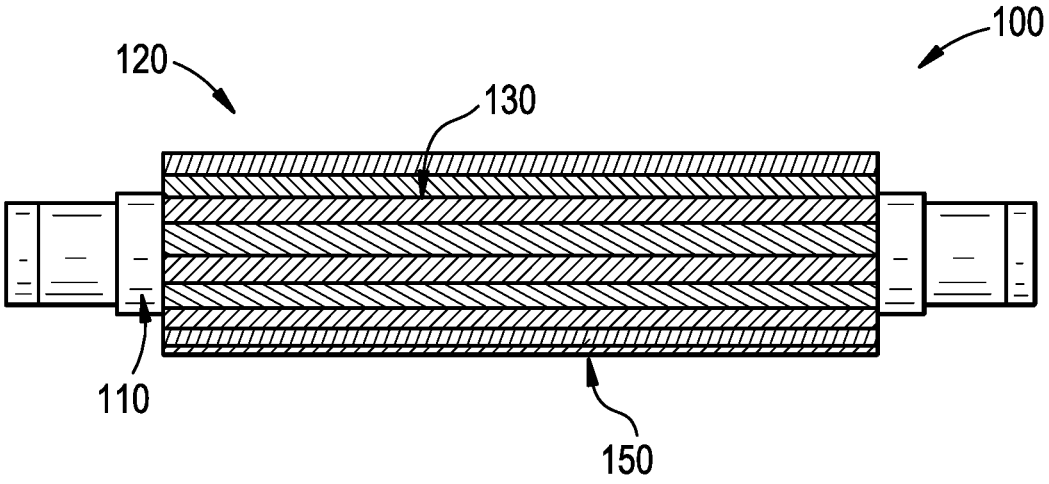
FIG. 1C illustrates a side view of a fully stacked roller for forming heat transfer elements of heat exchangers, in accordance with an exemplary embodiment of the present disclosure.

Referring now to FIGS. 1A to 1C, a perspective view and a side view of a roller 100 for forming heat transfer elements of heat exchangers are respectively illustrated, in accordance with an exemplary embodiment of the present disclosure. The roller 100 is a stamp forming die for forming the heat transfer elements. The roller 100 includes a central shaft 110. The central shaft 110 may be a metallic shaft of any suitable length and diameter, depending upon industrial requirements. The central shaft 110 includes distal and proximal end portions 112*a* and 112*b* opposite to each other, and a middle portion 112*c* extending between the distal and proximal end portions 112*a*, 112*b*. In one form, the distal and proximal end portions 112*a*, 112*b* may be flanged to be operatively coupled to a suitable mechanical arrangement, which may rotate the central shaft 110 along its axis.

Further, the roller 100 includes a plurality of roller elements 120. The roller elements 120 may be adapted to be stacked on the central shaft 110.

In one preferred embodiment of the present disclosure, the roller elements 120 may be stacked to form a roller without the requirement of any central shaft, such as the central shaft 110. For example the roller without the central shaft may be produced from a series of roller elements 120 and rotated about a stub shaft on each end of the stacked assembly.

Each roller element 120 may be a substantially thin metallic sheet, which may be flat or non-flat, generally obtained by cutting a metallic sheet of required circumferential geometry such that when stacked may form the characteristics of the required heating element forming roll. In one embodiment, the roller element 120 may be of circular shape while in another embodiment the roller element 120 may of any shape other than circular. Further, in one another embodiment, the roller elements 120 may be cut by one of a laser cutting process, water jet cutting process or any other suitable digital cutting processes as known in the art. Front and side views of the roller element 120 are respectively illustrated in FIGS. 2A and 2B, and will be described in conjunction with FIGS. 1A to 1C. Each roller element 120 includes an outer periphery 122. Further, each of the roller element 120 may include a cutout 124 configured centrally there-across, defining an inner periphery 126 opposite to the outer periphery 122. Each roller element 120 includes a geometrical characteristic 130 configured across the outer periphery 122. In one embodiment, the geometrical characteristic 130 may include but not limited to at least one of undulations, corrugations, flats, notches, ribs, tabs, dimples and ripples, those are cut by required tools or may be cut by laser or any other digital methods. Each roller element 120 may include the geometrical characteristic 130, such as the undulation sections, the corrugation sections, the flat sections, the notch sections, the rib sections, the tab sections, the dimple sections and the ripples section or any other geometrical characteristic either in any desired combinations or alone, without departing from the scope of the disclosure.

As mentioned, in one embodiment, each of the roller elements 120 is adapted to be stacked on the central shaft 110. Each of the plurality of roller elements 120 is adapted to be stacked across entire length of the middle portion 112*c* of the central shaft 110, leaving the distal and proximal flanged end portions 112*a* and 112*b*. The roller elements 120 may be snugly stacked across the middle portion 112*c* on the central shaft 110 through the cutout 124. In FIGS. 1A and 1B, only a partial portion of the central shaft 110 is shown. Further in FIG. 3C, the roller elements 120 is shown to be stacked across entire length of the middle portion 112*c* of the central shaft 110 for forming the roller 100. In one embodiment of the present disclosure, for proper stacking of the roller elements 120 across the central shaft 110, an engaging arrangement 140 may be provided. The engaging arrangement 140 may include an engaging member 142 extending longitudinally on a surface 114 of the central shaft 110. The engaging arrangement 140 may further include a complementary engaging member 144 extending downwardly from the inner periphery 126 of each of the roller element 120 to match the engaging member 142, to stack the plurality of roller elements 120 on the central shaft 110. One of a variant of the engaging arrangement 140 may be a male-female engagement arrangement, in which the engaging member 142 may be a grove and the complementary engaging member 144 may be a protrusion that matched the grove.

The stacked roller elements 120 on the central shaft 110 configures the roller 100 with a circumferential surface 150 corresponding to the geometrical characteristic 130 of the stacked roller elements 120.

Figure 2A:
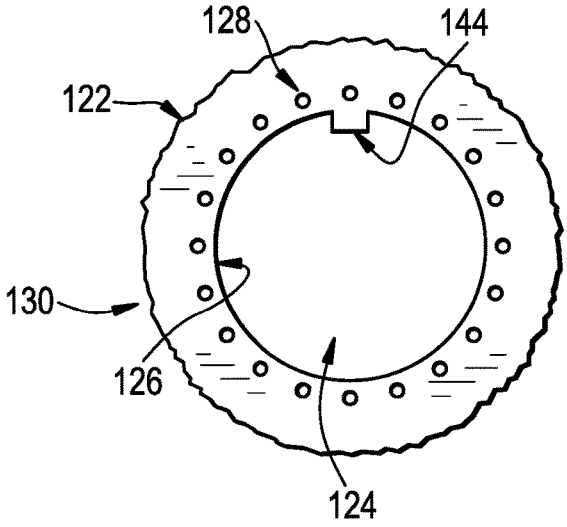
FIGS. 2A and 2B, respectively, illustrate front and side views a roller element of the roller of FIGS. 1A to 1C, in accordance with an exemplary embodiment of the present disclosure.
Figure 2B:
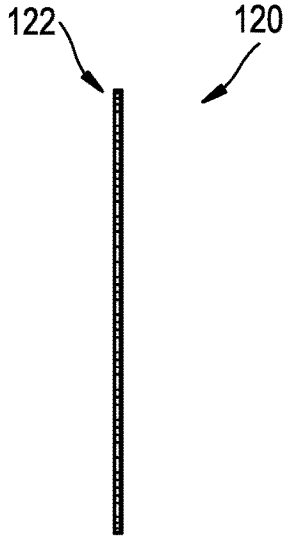
Figure 4:
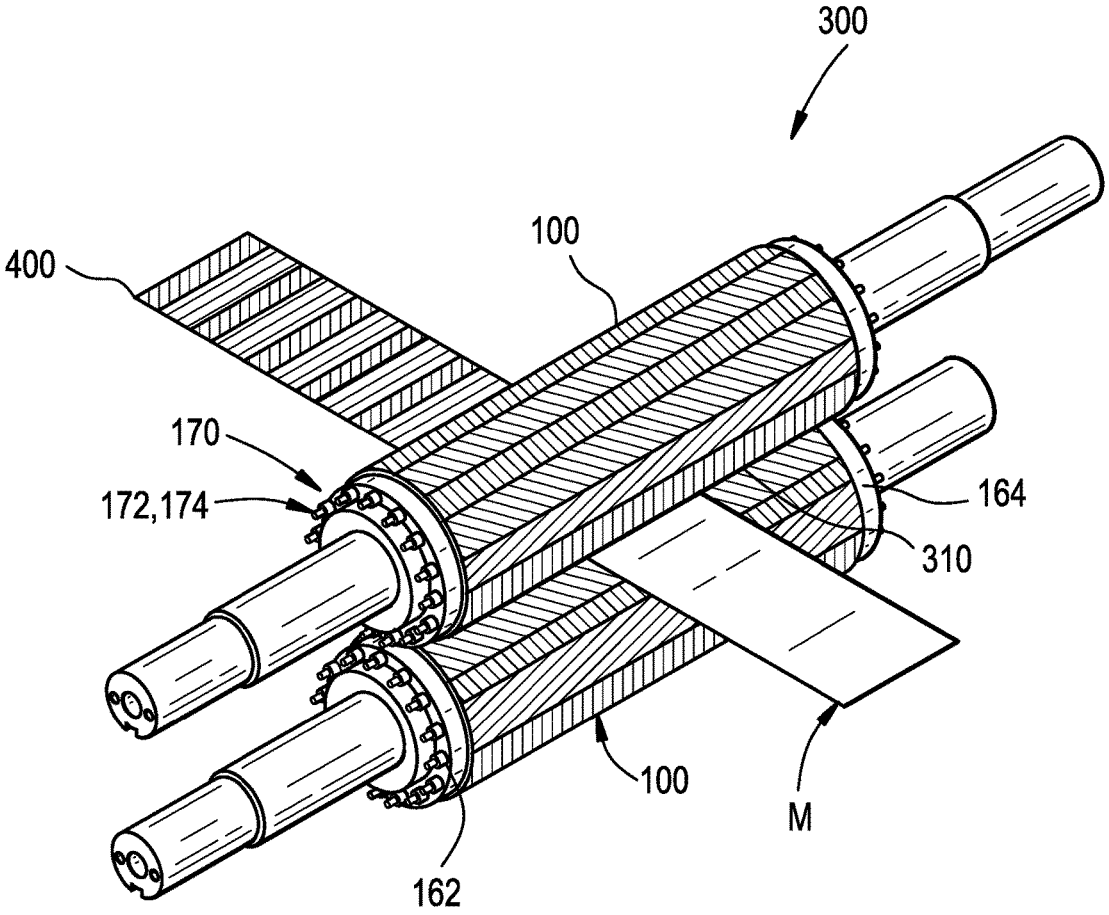
FIG. 4 illustrates a perspective view of a roller arrangement for forming heat transfer elements of heat exchangers, in accordance with an exemplary embodiment of the present disclosure.

Further, in one embodiment, as better evident in FIG. 4, the stacked roller elements 120 may be supported between two support plates 162, 164 and clutched together by using various elongated threaded rod and nut combinations 170 ('rod and nut combinations 170'). The support plates 162, 164 may be placed at opposite ends of the stacked roller elements 120 on the middle portion 112*c* of the central shaft 110. Further, the rod and nut combinations 170 may be used to clutch the stacked roller elements 120 along with the support plates 162, 164. Each roller element 120 may include through holes 128 (as shown in FIG. 2A) for enabling the rod and nut combinations 170 to clutch thereto together on the central shaft 110 along with the support plates 162, 164, which may also include through holes (not shown). Elongated threaded rods 172 may be inserted in the concentric through holes 128 of the stacked roller elements 120, and nuts 174 may be screwed on the elongated rods 162, thereby clutching together the stacked roller elements 120 along with the support plates 162, 164.

The stacked roller elements 120 that configures the circumferential surface 150 of the roller 100 corresponding to the geometrical characteristic 130 of the stacked roller elements 120 is utilized to form the heat transfer elements corresponding to the circumferential surface 150, and will be explained herein later with reference to FIGS. 4 and 5.

Figure 3:
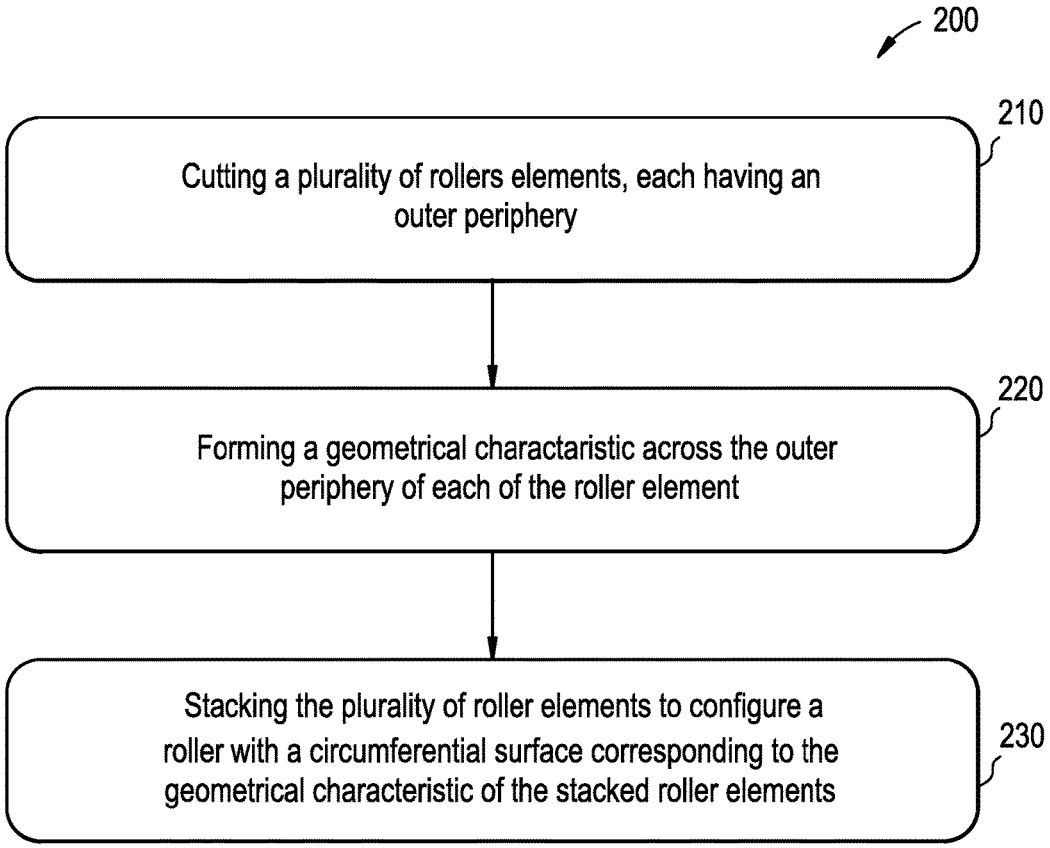
FIG. 3 illustrates flow diagram of a method for forming the roller of FIGS. 1A to 1C, in accordance with an exemplary embodiment of the present disclosure.

Referring now to FIG. 3, a flow diagram of a method 200 for forming the roller 100 is illustrated, in accordance with an exemplary embodiment of the present disclosure. At 210 of the method 200 various roller elements 120 from a metallic sheet are cut by utilizing a laser cutting process or a water-jet cutting process or any other suitable processes as know the art. At 220, the geometrical characteristic 130 across the outer periphery 122 of each of the roller element 120 are formed. Further, at 230, the roller elements 120 are stacked together. In one embodiment, stacking of the roller elements 120 may be done on the central shaft 110 as explained above. However, in another embodiment, staking of the roller elements 120 may be done without the central shaft 110. Further, in one embodiment, as explained above, stacking of the various roller elements 120, if done on the central shaft 110, such stacking may be enabled by the engaging arrangement 140. The detailed descriptions of the various components, its formation and stacking thereof may be derived from the above explanations of FIGS. 1A to 2B, which have been avoided herein for the sake of brevity of the disclosure.

Referring now to FIG. 4, a roller arrangement 300 may be provided for the formation of the heat transfer elements corresponding to the circumferential surface 150 of the roller 100, in accordance with an exemplary embodiment of the present disclosure. The roller arrangement 300, as illustrated in FIG. 4 will be explained in conjunction with FIGS. 1A to 3. The roller arrangement 300 includes a pair of rollers, such as the roller 100. For the sake of brevity, repetition of description of the roller 100 is excluded herein, and all the limitation of the roller 100 as explained above will be relevant herein. The pair of rollers 100 is disposed in parallel relation and in substantially spaced manner to configure a nip 310. Each of the roller 100 is rotatable along its axis in counter direction to other for enabling the nip 310 to receive a metallic sheet 'M.' The metallic sheet 'M' while passing through the nip 310 between the rollers 100 may be pressed to form a heat transfer element 400 with the geometrical characteristics 130 corresponding to the circumferential surface 150 of the rollers 100.

Figure 5:
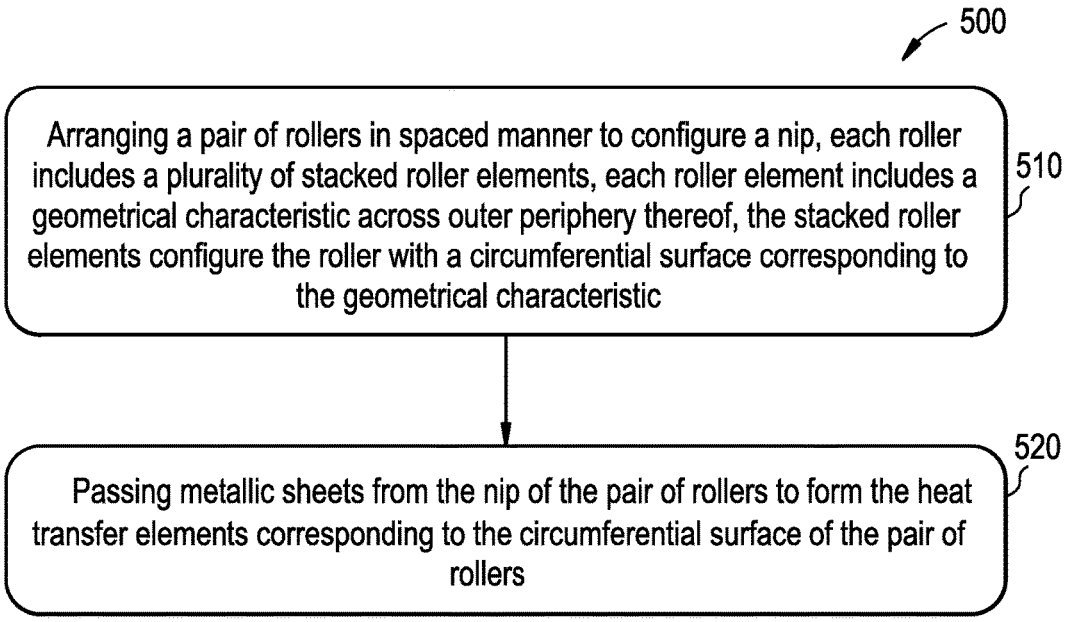
FIG. 5 illustrates a flow diagram of a method for forming heat transfer elements by utilizing the roller arrangement of FIG. 4, in accordance with an exemplary embodiment of the present disclosure.

Referring now to FIG. 5, a flow diagram of a method 500 for forming the heat transfer element 400 is illustrated, in accordance with an exemplary embodiment of the present disclosure. The heat transfer element 400 may be formed by the roller arrangement 300 of FIG. 4. At 510, the pair of rollers 100 are arranged in a manner as described above with reference to FIG. 4. Further at 520 the metallic sheet 'M' is allowed to through the nip 310 of the pair of rollers 100 to form the heat transfer elements 400 with the geometrical characteristics 130 corresponding to the circumferential surface 150 of the rollers 100, as explained above. For the sake of brevity, repetition of description of the same has been excluded herein.

The roller of the present disclosure is advantageous in various scopes. The roller with geometrical characteristics is comparatively economical, easy and less time consuming in formation as against the conventional machined rollers. Roller elements (with geometrical characteristics) that are stacked to form the roller, may be easily produced by laser cutting processes, reducing cost and development time from months to hours. Upfront cost associated with developing roller elements is substantially reduced due to preclusion of machining process as required while forming conventional heat transfer elements. Further, forming of the geometrical characteristics may now not be limited to available machining processes, thereby increasing the scope of formation of various new geometries as per demand of future. Moreover, loading and unloading of rollers from roller arrangements is precluded each time a new heat transfer element profile is required to be formed due to the stacking of the various roller elements.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

The invention claimed is:

1. A roller for forming heat transfer elements of heat exchangers, the roller comprising:

a central shaft; and a plurality of roller elements, each defining an outer periphery, each roller element comprising a geometrical characteristic configured across the outer periphery thereof, the plurality of roller elements adapted to be stacked on the central shaft, the stacked roller elements on the central shaft configures the roller with a circumferential surface corresponding to the geometrical characteristic of the stacked roller elements, to form the heat transfer elements corresponding to the circumferential surface;

wherein the geometrical characteristic of each of the roller elements has at least a first section of a first geometric characteristic and a second section of a second geometric characteristic positioned on a circumferential periphery of each of the roller elements, such that the circumferential surface of the stacked roller elements has at least the first geometric characteristic and the second geometric characteristic; and wherein the first geometric characteristic is different from the second geometric characteristic.

2. The roller as claimed in claim 1, wherein each roller element comprises a cutout, defining an inner periphery opposite to the outer periphery, through which each roller element is stacked on the central shaft.

3. The roller as claimed in claim 2, further comprising an engaging arrangement to enable stacking of the plurality of roller elements on the central shaft, wherein the engaging arrangement comprises:

an engaging member extending longitudinally on a surface of the central shaft; and a complementary engaging member extending downwardly from the inner periphery of each roller element to match the engaging member to stack the plurality of roller elements on the central shaft.

4. The roller as claimed in claim 3, wherein the engaging member is a groove.

5. The roller as claimed in claim 3, wherein the complementary engaging member is a protrusion.

6. The roller as claimed in claim 1, wherein each roller element is a substantially thin metallic sheet having one of a flat shape or a non-flat shape, cut from a metallic sheet.

7. The roller as claimed in claim 1, wherein each roller element is shaped in one of a circular shape or a non-circular shape.

8. A roller for forming heat transfer elements of heat exchangers, the roller comprising:

a plurality of roller elements, each defining an outer periphery, each roller element comprising a geometrical characteristic configured across the outer periphery thereof, the plurality of roller elements adapted to be stacked to configure the roller with a circumferential surface corresponding to the geometrical characteristic of the stacked roller elements, to form the heat transfer elements corresponding to the circumferential surface;

wherein the geometrical characteristic of each of the roller elements has at least a first section of a first geometric characteristic and a second section of a second geometric characteristic positioned on a circumferential periphery of each of the roller elements, such that the circumferential surface of the stacked roller elements has at least the first geometric characteristic and the second geometric characteristic; and wherein the first geometric characteristic is different from the second geometric characteristic.

9. The roller as claimed in claim 8, wherein each roller element is shaped in one of a circular shape or a non-circular shape.

10. The roller as claimed in claim 8, wherein each roller element is a substantially thin metallic sheet having one of a flat shape or a non-flat shape, cut from a metallic sheet.

11. A roller arrangement for forming heat transfer elements of heat exchangers, the roller arrangement comprising:

a pair of rollers, each roller comprising, a plurality of roller elements, each defining an outer periphery, each roller element comprising a geometrical characteristic configured across the outer periphery thereof, the plurality of roller elements adapted to be stacked to configure the roller with a circumferential surface corresponding to the geometrical characteristic of the stacked roller elements, the pair of rollers disposed parallel in spaced manner to configure a nip, the pair of rollers rotatable along respective axes for enabling the nip to receive metallic sheets to form the heat transfer elements corresponding to the circumferential surface;

wherein the geometrical characteristic of each of the roller elements has at least a first section of a first geometric characteristic and a second section of a second geometric characteristic positioned on a circumferential periphery of each of the roller elements, such that the circumferential surface of the stacked roller elements has at least the first geometric characteristic and the second geometric characteristic; and wherein the first geometric characteristic is different from the second geometric characteristic.

* * * * *